United States Patent [19]

Akerman et al.

[11] 4,010,109

[45] Mar. 1, 1977

[54] DEVICE FOR MARKING FLUENT MATERIALS

[75] Inventors: Karol Akerman; Kurt Sauerwein, both of Dusseldorf, Germany

[73] Assignee: Kurt Sauerwein, Dusseldorf, Germany

[22] Filed: July 2, 1973

[21] Appl. No.: 375,635

[52] U.S. Cl. ..... 252/301.15; 252/301.1 R

[51] Int. Cl.[2] ..... B65C 3/00

[58] Field of Search ..... 252/301.15, 301.1 R

[56] References Cited

UNITED STATES PATENTS

| | | | |
|---|---|---|---|
| 3,468,808 | 9/1969 | Arino | 252/301.1 R |
| 3,749,556 | 7/1973 | Barak et al. | 252/301.1 R |
| 3,774,035 | 11/1973 | Litt | 252/301.1 R |
| 3,774,036 | 11/1973 | Gerhart | 252/301.1 R |
| 3,785,990 | 1/1974 | Benjamins et al. | 252/301.1 R |
| 3,799,883 | 3/1974 | Arino et al. | 252/301.1 R |
| 3,827,986 | 8/1974 | Charlton et al. | 252/301.1 R |
| 3,833,469 | 9/1974 | Robson | 252/301.1 R |

*Primary Examiner*—Brooks H. Hunt

[57] ABSTRACT

The invention is concerned with a device for use in marking fluent materials with a radio-active substance. A radio-active substance in an isotope generator continuously produces a relatively short life radio-active daughter substance and a solvent for the daughter substance is fed continuously in controlled quantities under pressure into the generator to dissolve the daughter substance and form an isotope carrier. The isotope carrier is discharged from the generator through a fixed pipe to an equalizing reservoir from which it is dosed into a container for the fluent material through a control valve.

7 Claims, 2 Drawing Figures

DEVICE FOR MARKING FLUENT MATERIALS

Figure 1:
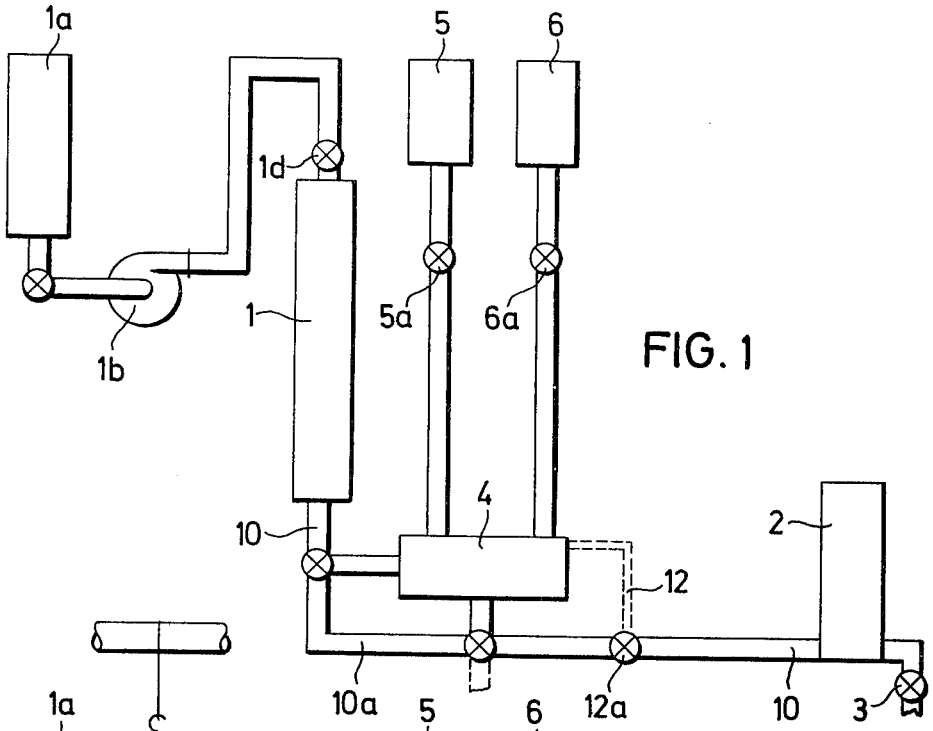

The invention relates to a device for marking granular liquid or gaseous fluent material by radioactive isotopes by a single delivery, by intermittent multiple delivery controlled, for example, in accordance with a time programme, or by continuous delivery, of an isotope combined with a carrier into the fluent material.

Such marking of fluent materials can, for example, be employed for the determination of masses moved by a conveyor system, for the determination of characteristic magnitudes of movement such as speed of flow, period of dwell and paths of propagation as well as for tracking mixing and separating processes and other procedures.

The employment of radioactive substances, which are produced by irradiation in nuclear reactors, accelerator installations or isotope generators, and added to the material to be marked in measured quantities, is known.

Also known is the adaptation of radioactive substances produced in this way to the particular purpose before adding them to the fluent material; for example by conversion into a form in which they can be well mixed with the material to be marked or into a form in which they are not adsorbed out of the marked liquid into heavy admixtures perhaps present in the latter or into the walls of the vessels and ducts containing the fluent material. Radioactive substances hitherto employed for marking fluent materials have necessitated the supervision of skilled personnel who in addition need special official approval. Moreover so called isotope laboratories are necessary, which are installations provided with expensive safety precautions and also in other respects complicated and costly, because of the use of substances drawn from nuclear reactors.

These special circumstances and commercial reasons have hitherto only permitted such markings as can be undertaken individually at particular intervals of time at a laboratory, and make it impossible to mark fluent materials at chosen places by radioactive isotopes continuously or rhythmically in accordance with a predetermined repeatable time programme, as would be desirable in many processes.

According to the invention, a device for use in marking fluent materials with a radioactive substance comprises an isotope generator charged with a radioactive substance which continuously produces a relatively shortlife radioactive daughter substance, means for feeding a solvent for the daughter substance in controlled quantities under pressure into the generator to dissolve the daughter substance and form an isotope carrier, a fixed pipe leading from the generator to an equalising reservoir for the isotope carrier and a dosing valve controlling the release of the isotope carrier from the reservoir in use to a container for the fluent material.

The new device is thus simple and easily portable, and enables fluent materials of very different kinds at practically any chosen place arbitrarily once or a number of times, intermittently or continuously to be marked by radioactive isotopes. The isotope to be introduced into the fluent material is produced at the place of application and combined with a carrier by which it can directly, or after conversion into a form suited to the particular purpose, be added to the material to be marked and then removed from it again.

This device connecting an isotope generator with a solvent container, and with an equalising reservoir and a continuous or intermittent dosing valve via fixed pipework requires, apart from a possible single general official approval or permission, neither specially skilled personnel nor additional devices subject to authorization. It allows, in its simplest form, the introduction of controlled quantities of the daughter isotope produced in the isotope generator and dissolved in a carrier liquid, from the generator into a container containing the material to be marked or into a conveyor system carrying this material and thereby into the material itself. Moreover the proportioning of isotopes combined with a liquid carrier can be effected in quantity and time by corresponding regulation of the feed of solvent to the isotope generator by means of a valve or a pump in the connecting pipe between the isotope generator and the solvent container or by the valve provided downstream of the reservoir. Pumps and valves can further be provided and controlled such that they can at option be operated arbitrarily by hand or automatically by a pulse transmitter in any cycle or intermittently in reciprocal dependence or continuously, or put out of operation. Furthermore, precautions can be taken to permit opening of the dosing valve only when it is connected to a container containing the material to be marked, and to enable the feed of solvent to the isotope generator only in this case or only so long as the volume of isotope carrier present in the reservoir has not reached a predetermined maximum level.

The marking of fluent materials directly by isotope solution expelled from the isotope generator will only be possible or permissible in relatively few cases, for example, with certain solids or with liquids which come in contact with no solids onto which the isotope introduced could be deposited or with which the isotope or its carrier could react chemically. Furthermore the only liquids which can be marked in this way, are those in which the isotope carrier can be well distributed without separation or precipitation.

In the interests of the most universal possible applicability of the device the solution of isotope expelled from the isotope generator may be treated prior to dosing into the material to be marked so that undesirable secondary phenomena or losses of isotope are excluded.

For this purpose a mixing and reaction vessel, which is arranged to be connected to at least one storage container for an additive to react with the isotope carrier may be connected in such a way relatively to the generator and the equalising reservoir that the isotope carrier flows from the generator to the reservoir selectively either directly or through the mixing and reaction vessel.

To the mixing and reaction vessel there may be connected at least storage vessels for additives by which the pH-value of the isotope carrier can be altered, as well as for additives which form complexes with the isotope and thereby prevent adsorption of the isotope onto the walls of the containers containing the fluent material, or onto a solid carried along by the liquid to be marked.

Insofar as it is a question of marking of liquids, especially organic liquids, with which the isotope solution, even after preparation in the mixing and reaction vessel, is immiscible, an extraction column can be connected in the connecting pipe between either the isotope generator or the mixing and reaction vessel and the reservoir, for extracting the isotope or a complex containing the isotope from an aqueous carrier liquid into an organic liquid which is fed to the column from a storage container.

The invention also creates the possibility of marking gases by isotopes. For this purpose the mixing and reaction vessel is provided with a heater and is connected to a storage container for a gas under pressure. When the gas flows through the carrier liquid in the heated vessel, if necessary after the carrier liquid has been brought by chemical additives into an easily volatilized form, the gas extracts the isotope, and passes to the equalising reservoir via a separate gas pipe which is then provided between the vessel and the reservoir.

The aqueous carrier liquid in the mixing and reaction vessel or in the extraction column, which has been freed from isotope, can be discharged into a collector container or fed back into the solvent container which feeds the isotope generator.

Figure 2:
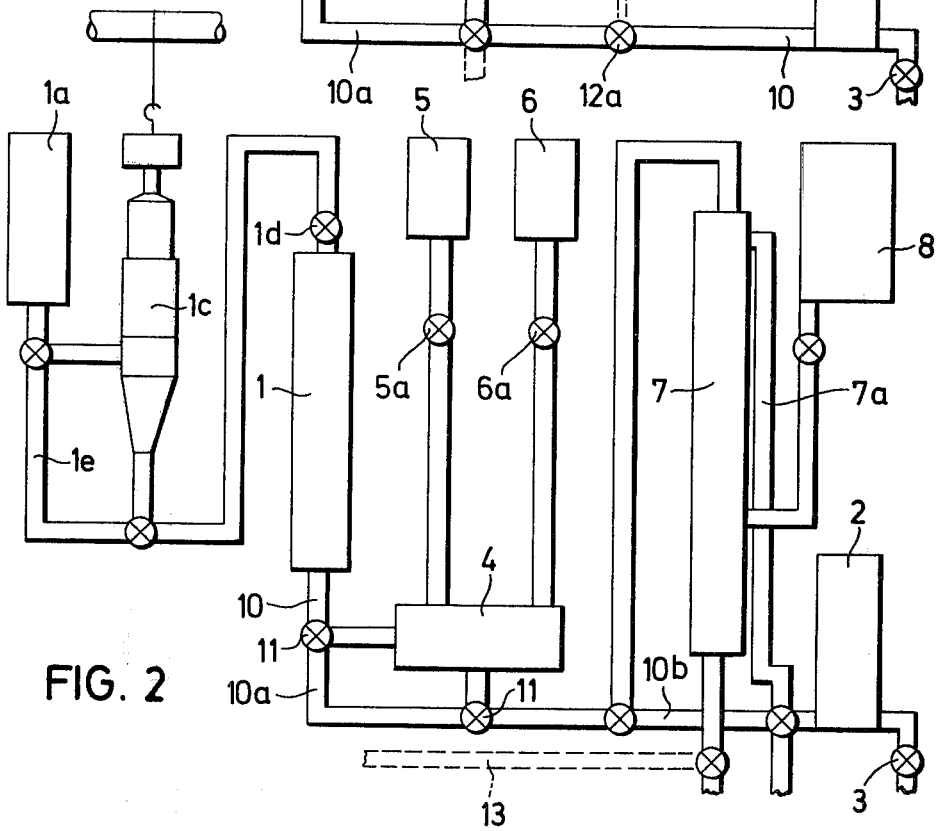

Two examples of devices constructed in accordance with the invention are illustrated diagrammatically in FIGS. 1 and 2 respectively of the accompanying drawings.

The FIG. 1 device consists essentially of an isotope generator 1 with a solvent container 1*a* and a rotary pump 1*b* in the connecting pipe between them, a collector and equalising reservoir 2, a connection pipe 10 and a proportioning and dosing valve 3 which can be connected to a container containing the material to be marked.

Furthermore a mixing and reaction vessel 4 is provided which can be switched in to a point 10*a* of the pipe 10 between the generator with the reservoir 2, by changeover valves or multiway cocks. The mixing and reaction vessel 4 is connected with storage containers 5 and 6 for additives or exchange materials by pipes with regulating and stop valves 5*a*, 6*a*. The vessel 4 for accelerating or bringing about reaction processes can be provided with a heating device (not shown).

FIG. 1 also shows in broken line a pipe 12 and a multiway cock 12*a* by which the reservoir 2 can be separated from the vessel 4 and a gas under pressure passed through the isotope solution present in the vessel 4 can be fed to the reservoir 2. Likewise indicated in broken line is a pipe for discharging the liquid in the vessel 4 which has been freed from isotope.

The FIG. 2 device differs from that of FIG. 1 inasmuch as the rotary pump 1*b* is replaced by a proportioner pipette 1*c* which is better suited to arbitrary or intermittent feeding of measured quantities of solvent to the isotope generator 1. If the solvent container 1*a* is arranged higher than the isotope generator 1 or if it contains, besides the stock of solvent, a compressed gas it can be connected with the generator 1 by a pipe 1*e* bypassing the pipette and by a regulating valve 1*d* with the isotope generator 1. In this event, in the case of both examples, a proportioning pump or pipette can be dispensed with and the proportioning of the solvent assigned to the appropriately formed and controlled valve 1*d*.

The FIG. 2 example is moreover provided with an extraction-column 7 in which the isotope coming from the generator 1 or the complex coming from the vessel 4 can be extracted out of its aqueous carrier liquid into an organic liquid. The extraction medium is fed to the column 7 from a storage container 8 at a height above its bottom and flows with the extracted isotope out of the top part of the column 7 via a pipe 7*a* downstream of a point of interruption 10*b* in the pipe 10 towards the reservoir 2. The isotope-free aqueous liquid collecting above the bottom of the column 7 can be discharged via a valve into a storage tank (not shown) or be fed back via a pipe 13 indicated in broken line into the storage container 1*a*.

Considering the small quantities of isotopes and isotope carriers which are necessary for marking of even large quantities of fluent materials, the whole device including the electrical means necessary for the control of valves and pumps can be accommodated in an easily portable container about the size of a small or medium suitcase.

EXAMPLES OF APPLICATIONS

Example 1

An aluminium sulphate solution employed, for example, in many ways in the paper industry is to be continuously marked. Into the isotope generator of the device as in FIG. 1 is inserted a carrier substance, for example, radioactive germanium-68 combined with silica gel. The total activity may amount to 50 mCi. In the generator there forms continuously as daughter isotope gallium-68 having a half-life period of 68 minutes. By means of the rotary pump a solution of 0.06 n NCl at a speed of flow of 0.2 ml/h is forced through the isotope generator as solvent. The gallium-68 solution thereby produced and expelled from the generator is led through the mixing and reaction vessel 4 and there treated with a rhodamine-B solution. Gallium-68 and rhodamine-B there form a complex dissolved in the carrier liquid. The complex solution expelled from the mixing and reaction vessel 4 is delivered via the collector and reservoir 2 and the proportioning valve 3 connected after the latter into the piping carrying the aluminium sulphate. The combination of the isotope with the rhodamine-B prevents deposit of the isotope on the walls of the piping.

Example 2

In a pipe through which alternately one after another different organic liquids, for example, different kinds of petroleum or petroleum products are conveyed, the respective ends of the quantities flowing through of one kind at any given time are to be marked.

In the isotope generator 1 of the device as in FIG. 2 is a carrier substance, for example, tin-113 combined with zirconium oxide. By means of the proportioning pipette 1*c* a quantity needed for one marking, of dilute hydrochloric acid is forced through the generator, which dissolves the daughter isotope indium-113 with the half-life period of 100 minutes.

In the mixing and reaction vessel 4 sodium benzoate solution from, for example, the storage container 5 is added to the indium-113 solution in such quantity that it combines into a complex with the whole of the indium isotope present in the vessel 4. The liquid containing this complex is then passed from the mixing and reaction vessel 4 to the top end of the extraction column 7, in which an organic liquid, in this example n-amylalcohol, taken from the storage container 8 rises from the bottom upwards. This liquid washes out of the descending aqueous solution the indium-113 complex and flows with it to the reservoir 2 from which at a given time it can be delivered in measured quantity into the piping carrying the petroleum product.

The solvent freed of the isotope-containing complex, collecting above the bottom of the extraction-column, can be passed back through the pipe 13 into the storage container 1*a*.

Example 3

Gas flowing through a pipe is to be continuously marked by an inert radioactive gas.

In the isotope generator 1 of the device as in FIG. 1 is radioactive rubidium-83 combined with a carrier substance. The total activity amounts for example, to 60 mCi. In the generator krypton-83 forms continuously as daughter isotope. By means of the proportioner-pump 1*b* pure deionized water is passed through the generator, in which the krypton-83 dissolves. The isotope solution which arrives next in the mixing and reaction vessel 4 is there heated and nitrogen under pressure, for example, from the storage container 6 is bubbled through it. The nitrogen extracts the krypton isotope and with the latter is passed through the pipe 12 and the multiway cock 12*a* to the collector and reservoir 2 from which it is passed to the piping carrying the gas to be marked.

We claim:

1. A device for marking contained industrial fluent materials with a radio-active substance, said device comprising, in combination, an isotope generator charged with a radio-active substance with continuously produces a relatively short-life radio-active daughter substance, means for feeding a solvent for said daughter substance in controlled quantities under pressure into said generator to dissolve said daughter substance and form an isotope carrier, an equalizing reservoir for temporarily storing an isotope carrier conducted thereto, a mixing and reaction vessel adapted to be connected to at least one storage container containing an additive which reacts with said isotope carrier, a fixed pipe leading from said generator to said equalizing reservoir, means interconnecting the generator with the mixing and reaction vessel for selectively shunting the isotope carrier from the pipe to the mixing and reaction vessel, means for selectively coupling the output of the mixing and reaction vessel to the pipe, and a dosing valve permanently coupled between the output of said equalizing reservoir and the container for said fluent material for controlling the release of said carrier from said reservoir to said container.

2. A device according to claim 1, further comprising an extraction-column for extracting said isotope out of said solvent into an organic liquid, a storage container feeding said organic liquid to said extraction column, and means selectively connecting said extraction column between said mixing and reaction vessel and said equalising reservoir.

3. A device according to claim 1, further comprising a heater for said mixing and reaction vessel, a storage container for gas under pressure and connected to said vessel whereby gas flowing through heated isotope carrier present in said vessel is arranged to extract said isotope, and means selectively connecting said vessel to equalising chamber via a pipe for said carrier gas.

4. A device according to claim 2, wherein said extraction column is connected to a storage container for said solvent such that solvent from the said isotope has been extracted by said organic liquid is returned to said solvent storage container.

5. A device according to claim 3, wherein said mixing and reaction vessel is connected to a storage container for said solvent such that solvent from said isotope has been extracted by said gas is returned to said solvent storage container.

6. A device for use in marking contained industrial fluent material with a radioactive substance, comprising in combination, an isotope generator charged with a radioactive substance which continuously produces a relatively short-life radioactive daughter substance;

automatically controlled dosing means connected to said isotope generator for feeding a solvent for said daughter substance into said generator to dissolve said daughter substance and thereby form an isotope carrier;

an equalizing reservoir for temporarily storing an isotope carrier conducted thereto;

a mixing and reaction vessel adapted to be connected to at least one storage container containing an additive which reacts with said isotope carrier;

a fixed pipe leading from said generator to said equalizing reservoir;

means interconnecting the generator with the mixing and reaction vessel for selectively shunting the isotope carrier from the pipe to the mixing and reaction vessel;

means for selectively coupling the output of the mixing and reaction vessel to the pipe;

and a dosing valve permanently coupled between the output of said equalizing reservoir and the container for said fluent material for controlling the release of said carrier from said reservoir to the container for said fluent material.

7. The device as set forth in claim 1, wherein the device further comprises a container for said solvent to which the dosing means are connected, and wherein said dosing valve and dosing means are operatively connected to each other and said dosing valve is opened so that said solvent is only fed to said generator when the level in the isotope carrier is below a predetermined level and only when solvent is present in said solvent container.

* * * * *